United States Patent [19]

Deyesso et al.

[11] 4,362,243

[45] Dec. 7, 1982

[54] TOOL HOLDER

[76] Inventors: Margaret J. Deyesso; George G. Deyesso, both of 118 Oak St., Pembroke, Mass. 02359

[21] Appl. No.: 281,013

[22] Filed: Jul. 6, 1981

[51] Int. Cl.[3] ..... B65D 85/28

[52] U.S. Cl. ..... 206/373; 206/562; 211/60 T

[58] Field of Search ..... 206/372, 373, 374, 562; 220/307; 211/60 T

[56] References Cited

U.S. PATENT DOCUMENTS

| | | | |
|---|---|---|---|
| 1,249,439 | 12/1917 | McCoy | 206/373 |
| 1,469,938 | 10/1923 | Kennedy | 206/373 |
| 1,739,793 | 12/1929 | Hardt | 206/373 |
| 2,461,177 | 2/1949 | Prestien | 206/373 |
| 2,829,778 | 4/1958 | Carabet | 206/373 |
| 3,537,575 | 11/1970 | Haldegger | 220/307 |

*Primary Examiner*—Joseph Man-Fu Moy

[57] ABSTRACT

This invention discloses a tool holder insert adapted to engage the inner surface of the wall of a plastic bucket between the open end and closed bottom. The insert is annular in configuration and includes apertures and notches for holding tools, sporting equipment and the like. A variation of the tool holder is a strip of metal which is bent into a sinuous, circular configuration which is fastened to the inner surface of the wall of the plastic bucket between the open end and closed bottom. The sinuous configuration of the variation provides notches and flutes which hold the tools, etc.

Spacers which engage the insert may be used to increase the overall diameter of the insert, if necessary.

2 Claims, 8 Drawing Figures

TOOL HOLDER

BACKGROUND OF THE INVENTION

This invention relates generally to devices for storing articles and more specifically to a device for storing and carrying tools, sporting equipment and the like.

A popular method of carrying tools, fishing gear, etc. is to use a large plastic bucket with a handle. Since the tools are simply placed in the bottom of the bucket, individual tools may be difficult to locate and the tools may damage each other due to impacts between them.

SUMMARY OF THE INVENTION

The improved storage device comprises a tool holder insert adapted to engage the inner surface of the wall of a container having an open top and a bottom closed by a base portion. The insert engages the container on a horizontal plane between the top and the base portion and has means of supporting (i.e. holding) a tool or the like.

The means of holding the tools may be through apertures formed in the insert whose axis are in spaced parallel relation with the central vertical axis of the container when the insert is engaged with the container.

The insert may also utilize notches or indentations, which open toward the vertical central axis of the container when the insert is engaged, and flutes which open toward the internal surface of the wall of the container as means of holding the tools.

The insert is annular in configuration when engaged to the container providing a large central through opening permitting access to the container below the insert.

The insert may be a solid ring or may be a strip of material which forms a ring when engaged circumferentially to the inner surface of the wall of the container.

Removable spacers may be provided engageable with the insert to increase the overall diameter of the insert.

BRIEF DESCRIPTION OF THE DRAWING

Further details are explained below with the help of the examples illustrated in the attached drawing in which.

DESCRIPTION OF THE PREFERRED EMBODIMENTS

Figure 1:
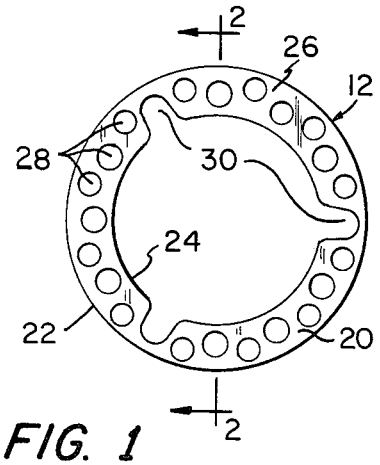
FIG. 1 is a top plan view of the tool holder insert according to the present invention.
Figure 2:
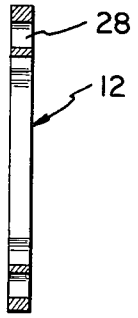
FIG. 2 is a cross-sectional view taken on line 2—2 of FIG. 1.
Figure 7:
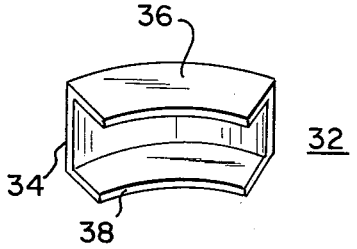
FIG. 7 is a perspective of a spacer for use with the tool holder insert shown in FIGS. 1 and 2.

There is shown in the drawing a plastic bucket 10 and a tool holder insert 12. The bucket 10 is open at one end 14 and closed at the other by a base portion 16 with its open end 14 of greater diameter than the closed end. In other words, the wall 18 of the bucket 10 tapers from the open end 14 to the base portion 16. For example, the open end may have a diameter of 11½ inches and the base portion may have a diameter of 10 inches. The bucket 10 may have a height of 14 inches.

The tool holder insert 12 is ring-like or annular in configuration, is formed of wood or plastic or metal and includes a body portion 20. The body portion 20 has an outer facing surface 22 and an inner facing surface 24. The outer facing surface 22 defines the circumference of the body portion 20 and the inner facing surface 24 is in spaced parallel relation with the outer facing surface 22 and defines a comparatively large central aperture of the body portion 20. The tool holder insert 12 may have an outer diameter of 11", a thickness of ¾" and the distance between the outer and inner facing surfaces 22, 24 may be 1¾".

The upper surface 26 of the tool holder insert 12 positioned between the outer and inner facing surfaces 22, 24 has a series of through apertures 28 formed therein. The apertures 28 may be of various diameters, for example, 1⅛" and ⅞" and their axis are in spaced parallel relation to the vertical planes of the outer and inner facing surfaces if those surfaces are in parallel relation to each other. In the embodiment shown in the drawing, three notches 30 are formed through the inner facing surface 24 approximately three quarters of the distance between the inner and outer facing surfaces 22, 24. The width of the notches 30 may be 1¼ inches.

The outer diameter of the insert 12 is less than the open end 14 of the bucket 10 and is greater than the base portion 16 of the bucket 10.

To use the insert 12, it is pushed down into the bucket 12 with the horizontal plane of the upper surface 26 facing away from and maintained in substantially parallel relation to the horizontal plane of the base portion 16 of the bucket 10. Since the overall diameter of the insert 12 is less than the open end 14 and greater than the base portion 16, a press fit will be established between the outer facing surface 22 and the inner surface of the wall 18 of the bucket 10 on a horizontal plane approximately 10½" above the horizontal plane of the base portion 16.

Tools 31 such as carpenter tools or mechanic's tools can now be engaged through the apertures 28 and in the notches 30 while the center aperture of the insert 12 permits the bucket 12 to be used to carry irregular configured or very large tools.

Most of the presently available plastic buckets 10 of the general size disclosed herein have dimensions which will permit proper engagement of the insert 12. Occasionally, however, a bucket is encountered whose base portion is greater than the overall diameter of the insert 12. In that case, spacers 32 are utilized. The spacers may be formed from any flexible material such as vinyl plastics, rubber or the like. The spacer 32 comprises a back 34, a top portion 36 and a bottom portion 38. The back 34 is generally rectangular in external configuration, and is arced on its horizontal plane to conform to the arc of the outer facing surface 22 of the insert 12. The top portion 36 is generally a sharply truncated cone in configuration whose leading face edge is arced to conform to the arc of the inner facing surface 24 of the insert 12. The integral top portion 36 extends at right angles from the top edge of the back 34 and the bottom portion 38 having a configuration similar to the top portion 36 extends from the bottom edge of the back 34 in right angle relation thereto and in parallel relation to the top portion 36. The spacer 32 is dimensioned as follows: the back 34 is 1.5" long, 0.75" wide and 1/16" thick. The top and bottom portions 36, 38 are each 1.5" long, 0.23" wide and 1/16" thick. These dimensions position the inner surfaces of the top and bottom portions 0.75" apart. To engage the inner surface of the wall of the larger bucket, three of the trough-like spacers 32 are used. One of each of the spacers 32 is engaged to the insert 12 with its midpoint positioned at a point which is on the periphery and which is ⅓ the circumferential distance from the midpoint of each of the other positioned spacers 32. Engagement with the insert 12 is accomplished by placing the top portion 36 into superposed abutting relation with the upper surface 26 of the insert 12, the back 34 into substantially butting parallel relation with the outer facing surface 22 and the bottom portion 38 is butted against the bottom surface of the insert 12. In other words, the inner surface of the top portion 36 is passed over the upper surface 26 of the insert 12 while simultaneously the inner surface of the bottom portion 38 is passed under the lower surface of the insert 12 until the back 34 substantially buts against the outer facing surface 22 of the insert 12. This, in effect, adds ⅛ of an inch to the diameter of the insert 12 which will permit proper engagement of the insert between the open top of the container and its base portion.

Figure 3:
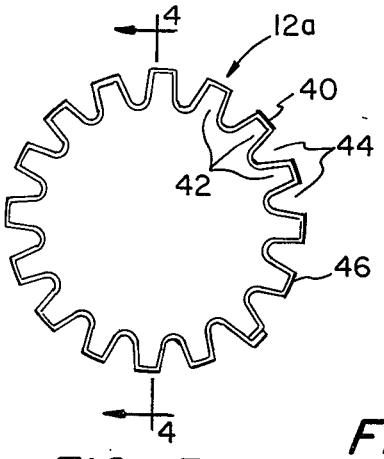
FIG. 3 is a top plan view of a variation of the tool holder shown in FIG. 1.
Figure 4:
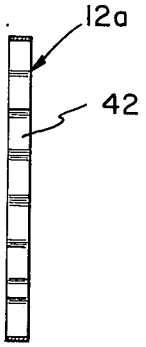
FIG. 4 is a cross-sectional view taken on line 4—4 of FIG. 3.
Figure 8:
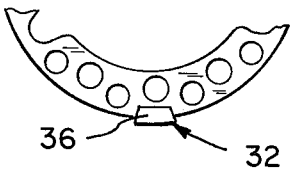
FIG. 8 is a top plan view of the spacer shown in FIG. 7 engaged to the tool holder insert, the tool holder insert broken away.
Figure 5:
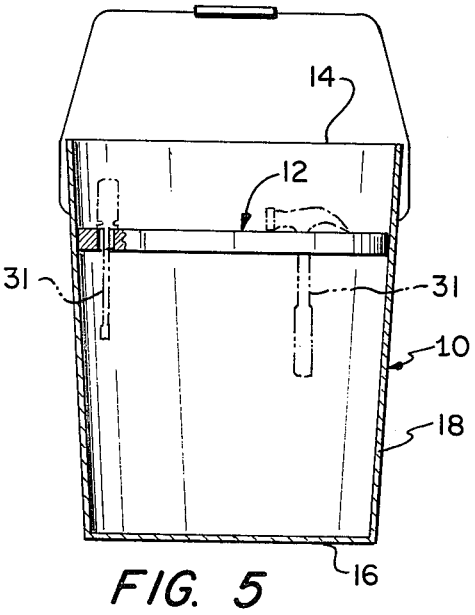
FIG. 5 is a cross section of a container having the tool holder insert engaged therewith.
Figure 6:
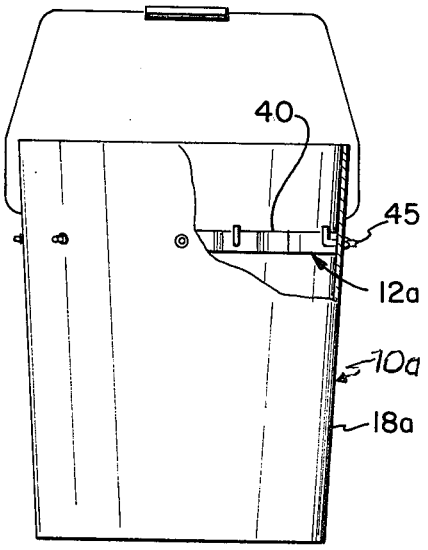
FIG. 6 is a side elevational view of a container with a portion of the wall broken away to show the variation of the tool holder insert shown in FIGS. 3 and 4 attached to the container.

A variation of the insert 12 is disclosed in FIGS. 3, 4 and 6 showing a tool holder insert **12*a* comprising a base portion 40 manufactured from a malleable material such as soft steel or aluminum. The base portion 40 is produced from a ¾" strip of material having a thickness of 1/16" and is formed into a sharply convoluted configuration which provides indentations 42 and flutes 44. The convoluted base portion 40 is bent into a circle whose outer circumference is substantially the same as the inner circumference of a bucket 10*a* on a horizontal plane approximately ⅓ of the total height of the bucket measured from the top of the bucket 10*a*. The bending of the base portion 40 into the mentioned circle either buts the free terminal ends of the base portion 40 or positions one free terminal end into overlapping abutting relation with the other. When in position in the bucket 10*a*, the indentations 42 open toward the vertical axis of the bucket 10*a* while the flutes 44 open toward the inner surface of the wall 18*a* of the bucket 10*a*. Screws or other appropriate fastening means 45 are engaged through the bases 46 of the indentations 42 which are located at points positioned at 0°, 90°, 180° and 360° of the interior circumference of the bucket 10*a* on which the variation 12*a* is placed. An additional screw or screws may be needed to pin the terminal ends of the base portion 40. Obviously, the screws, after passing through the base portion 40, are threaded into the wall of the bucket 10*a*. The widths of the openings provided by the indentations 42 and flutes 44 may be varied to provide for different size tools and implements. The open center of the bucket 10*a* can be used to carry large or oddly shaped items and the bucket 10*a* may have similar dimension and configuration as the bucket 10**.

What we claim is:

1. The combination of a container and a tool holder insert, the container including an open top and bottom, the bottom closed by a base portion, the top and base portion connected by a continuous wall, the wall having an inner surface, the insert having a continuous, uninterrupted outer facing surface butted against the inner surface between the top and base portion and the insert having an annular configuration with a central aperture formed therethrough and having an inner facing surface and an upper surface, the outer facing surface being spaced from the inner facing surface and butted against the inner surface of the wall, between the top and base portion, and having at least one hole formed through the upper surface and the remaining portion of the insert, the vertical axis of the hole in parallel relation to the vertical axis of the central axis, the hole adapted to hold a tool or the like, the inner facing surface of the tool holder insert having a notch formed therein, the notch adapted to hold a tool or the like.

2. The combination of a container and a tool holder insert as set forth in claim 1 wherein a series of holes is formed through the upper surface of the tool holder insert, the holes being in spaced relation to each other and the holes adjacent to each other being in staggered relation.

* * * * *